United States Patent [19]

Cioni et al.

[11] 3,940,909

[45] Mar. 2, 1976

[54] MACHINE FOR FILLING AND SEALING GLASS VIALS STARTING FROM CLOSED VIALS

[76] Inventors: Elisabetta Cioni; Lucia Cioni; Rovena Anichini Cioni, all of Via di Marciano 22, Siena, Italy, I-53100

[22] Filed: Aug. 16, 1974

[21] Appl. No.: 498,174

[30] Foreign Application Priority Data

Aug. 21, 1973 Italy ..... 9593/73

[52] U.S. Cl. ..... 53/167; 53/131; 53/266 R; 53/381 R

[51] Int. Cl.[2] ..... B65B 7/16

[58] Field of Search ... 53/167, 131, 53/381 R, 266; 101/35; 198/25

[56] References Cited

UNITED STATES PATENTS

| | | | |
|---|---|---|---|
| 2,530,230 | 11/1950 | Cozzoli | 53/266 X |
| 2,689,677 | 9/1954 | Unger | 53/266 |
| 2,838,893 | 6/1958 | Sickel | 53/167 X |
| 2,896,381 | 7/1959 | Lange | 53/266 X |
| 3,305,065 | 2/1967 | Babunovic et al. | 198/25 |
| 3,545,402 | 12/1970 | Dichter | 101/35 X |

*Primary Examiner*—Donald R. Schran
*Assistant Examiner*—Leon Gilden
*Attorney, Agent, or Firm*—McGlew and Tuttle

[57] ABSTRACT

The machine and includes an endless conveyor having receptacles for receiving vials in a vertical position. The conveyor is indexed during each cycle of operation so that a plurality of vials is presented at a means which engraves a notch or mark on the necks of the initially closed vials so that, at a subsequent station, hammers serve to fracture the necks immediately upstream of a filling station. After the vials have been filled, they are resealed by multiple burners and a pinch device, the sealing taking place as the vials are rotated by friction wheels.

8 Claims, 16 Drawing Figures

MACHINE FOR FILLING AND SEALING GLASS VIALS STARTING FROM CLOSED VIALS

BACKGROUND OF THE INVENTION

This invention relates to a machine for filling and sealing glass vials starting from closed vials.

SUMMARY OF THE INVENTION

According to the present invention there is provided, in a machine for filling and sealing glass vials, endless conveyor means having an upper run, a lower run and receptacles arranged to receive vials in a vertical position, means for indexing the conveyor means during each cycle, means for supplying a plurality of closed vials to the conveyor means at a station adjacent the lower run, the vials being displaced into the receptacles from below, engraving means disposed at a station adjacent the lower run of the conveyor means, means for fracturing the necks of the vials, filling means at a station adjacent the upper run at which the vials are filled, sealing means including multiple burners, pinch means for the simultaneous closure of a plurality of filled vials and means to rotate the vials during the action of the burners and pinch means on the vials.

In combination with a vials feed system, including upward thrust means for the vials, the machine may additionally comprise tilting gripper means to receive several vials and retain them with a resilient retaining effect, tilting control means of the gripper means to arrange the vials beneath the lower run and with the closed neck downwardly directed, and expelling means to axially urge the vials to transfer them from the tilting gripper means to the seats of the conveyor.

The tilting gripper means may be assembled rotatably on an oscillating unit, and may be rotated by means of teeth thereof meshing with a geared sector concentric to the oscillation axis.

The engraving means may advantageously include an engraving system slidable relatively to the vials in their dwell station, comprising a high frequency motor and a steel disc fixed onto the motor shaft and rotating at a high speed. A centering device for the vials for aligning them on the same sliding axis of the engraving unit may also be provided.

A system of flames may be provided to invest the necks of the vials to be severed, to externally sterilize the facture zone and increase also the internal pressure of the vial with the temperature, so that, upon fracture, there is an outward blast of air, so as to avoid the penetration of fragments into the vials.

Downstream of the engraving positions and along the conveyor lower run, two sets of hammers may serve as fracturing means, acting on the vials necks to sever them at the engraving zone.

BRIEF DESCRIPTION OF THE DRAWINGS

One embodiment of a machine for filling and sealing glass vials will now be described, by way of example, with reference to the accompanying diagrammatic drawings, in which.

DESCRIPTION OF THE PREFERRED EMBODIMENT

Figure 1:
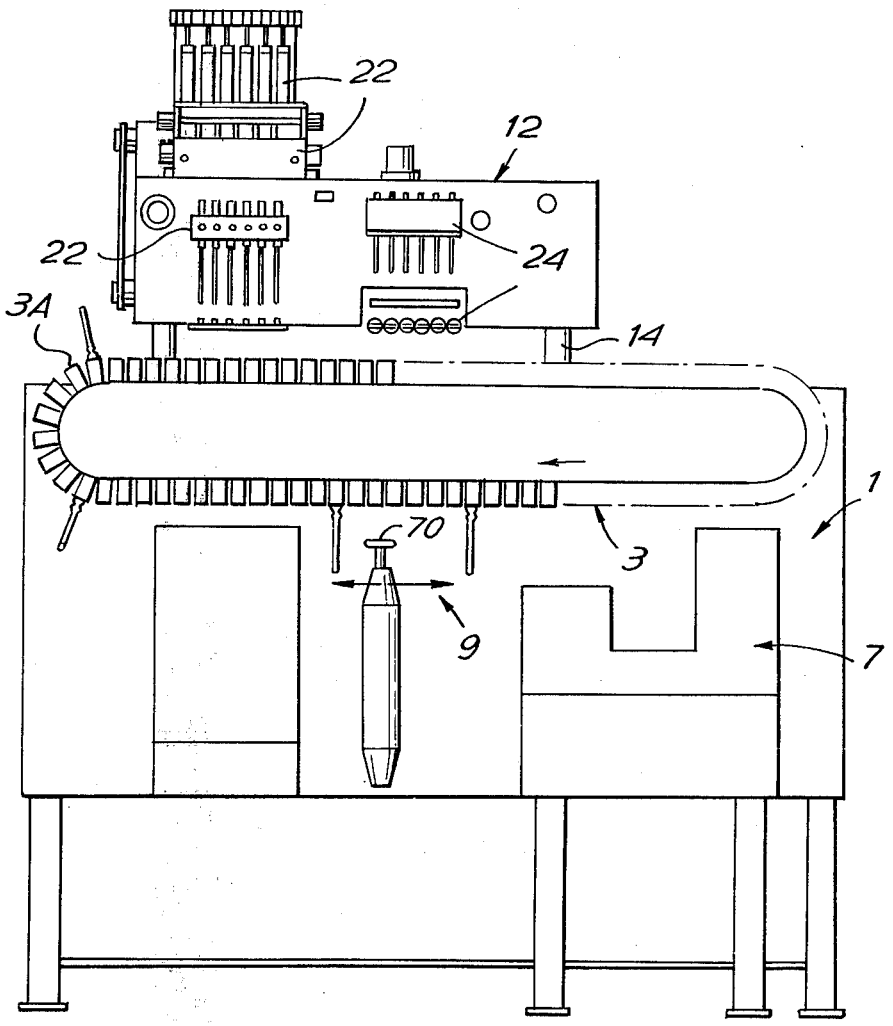
FIGS. 1 and 2 are, respectively front and side elevations of the embodiment.
Figure 2:
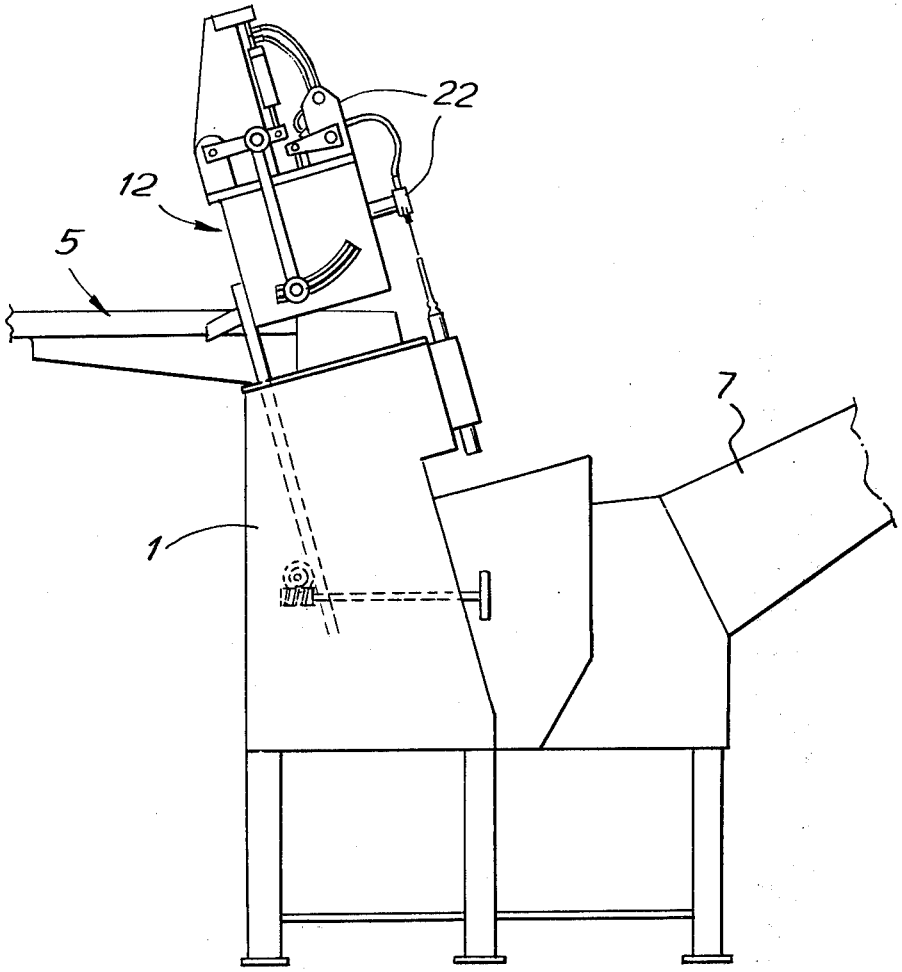

The machine comprises a lower, stationary, base or casing 1, a vial-carrying endless geared belt or chain conveyor 3, movable in a vertical plane with an associated trip motion system, and associated mechanism for rotating the vials at a sealing station. The conveyor 3 carries rotary containers or other receptacles 3A. An unloading mechanism 5, a loading mechanism 7, an engraving device, a severing device 9, and a drive motor 11 are also included in the machine. An upper casing 12 is mounted above the casing 1 and is adjustable in height by means of adjustable columns 14.

A main drive shaft is synchronized through a drive 18, 20 (FIG. 3) connected to a speed reduction gear box 11A of the motor 11, in the lower casing. This shaft is provided with adjustable cams, which cooperate with respective followers in order to operate the various drives.

The casing 12 also carries a filling mechanism 22, comprising syringes, needles and opening and closing valves for the product, and a vial-closure mechanism 24, constituted by gas burners and by grippers for engaging the excess of the length of the necks of the vials.

The machine is supplied directly from baskets and/or from cardboard boxes containing closed vials as they arrive from a glass blowing machine. The time gap between one given loading operation and the next depends upon the dimensions of the box or basket, upon the vial diameter and thus upon the capacity. At the loading station, the vials are arranged on a double grid 27 (FIGS. 6 and 7) having an inclined plane, and are distributed and arranged for tilting on a chain of the loading mechanism by reciprocable blades or knives 29 secured to two slides 30 controlled by a three-lobed cam 32 by means of a linkage 34A, 34B, 34C. The load on the tilting mechanism is displaced by means of expelling devices 36, secured on a slide 38 reciprocated by a cam 40 through a linkage 42A, 42B, 42C, the whole being tensioned by a spring 44 through a chain or belt 46.

Figure 4:
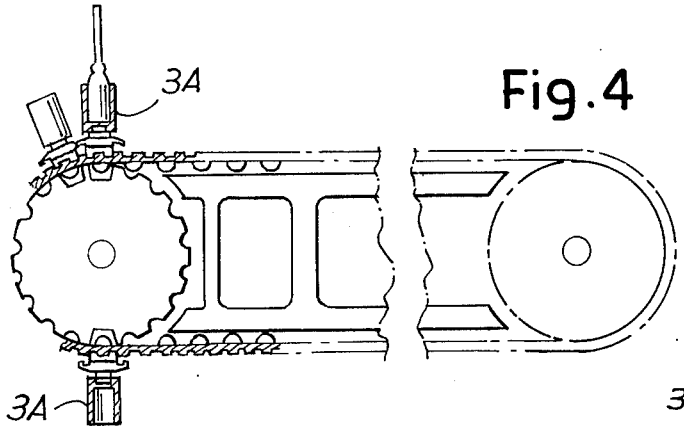
FIGS. 4 and 5 show details of a toothed belt endless conveyor.
Figure 5:
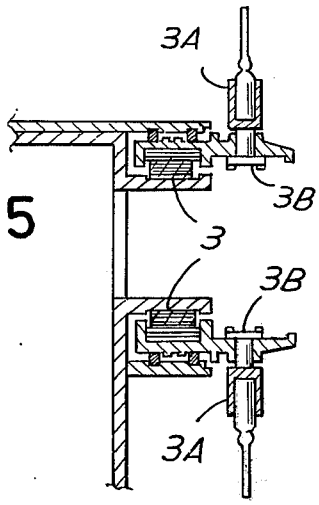
Figure 6:
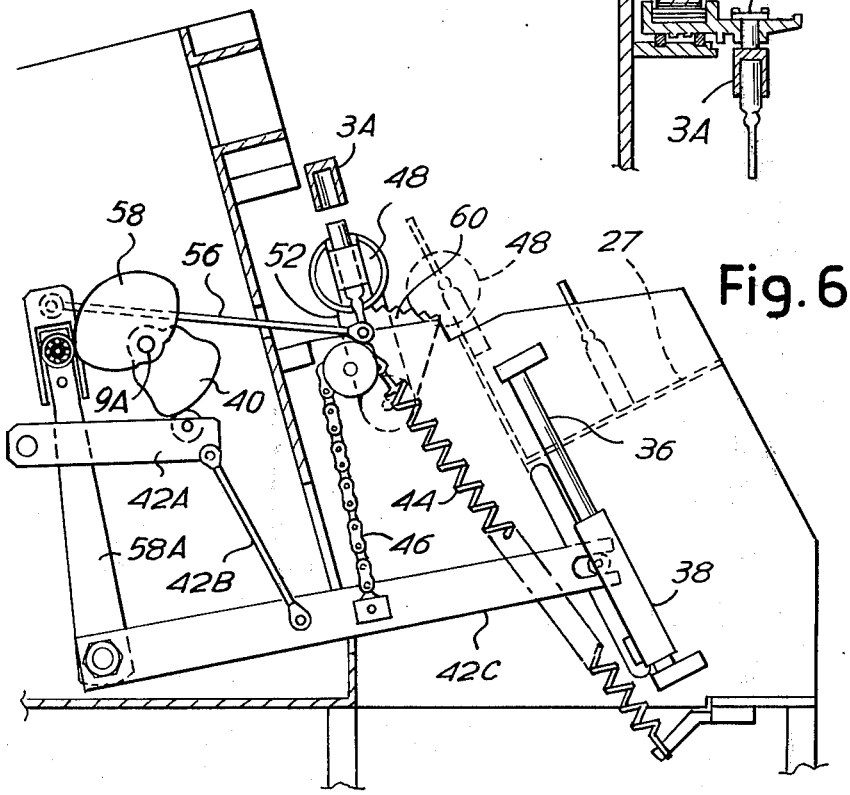
FIGS. 6 and 7 show details of a mechanism for loading and tilting the vials.
Figure 7:
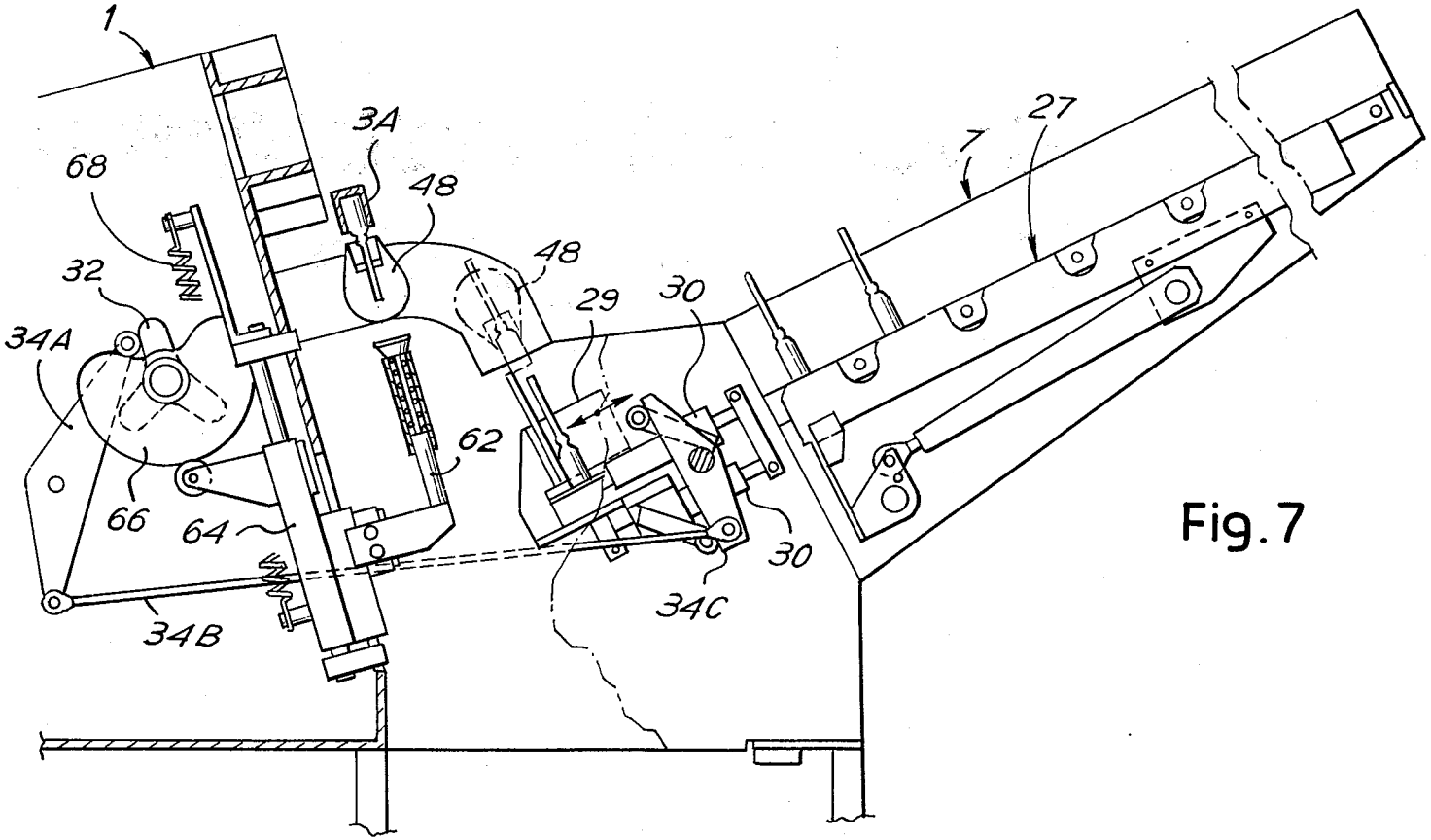
Figure 8:
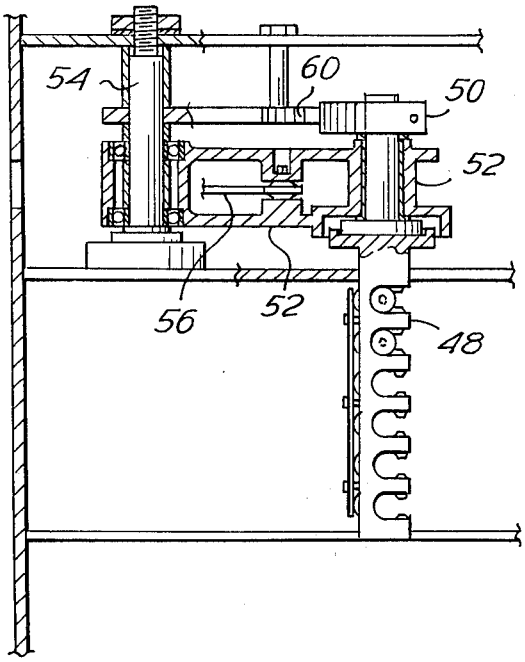
FIGS. 8 and 9 show, to an enlarged scale, a multiple gripper forming part of tilting mechanism.
Figure 9:
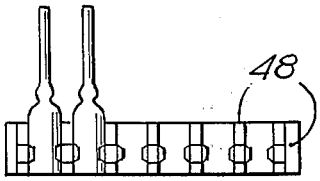

The tilting mechanism serves to overturn the vials so that they are presented beneath the containers 3A downwardly directed with respect to the chain or belt 3, i.e. with the neck downwardly directed, (see FIGS. 4 and 5). This tilting mechanism includes a multiple gripper 48 mounted on a sector gear 50, as best seen in FIGS. 6 and 8. The assembly 48, 50 is rotatably mounted on an oscillatory structure 52 pivoted on a pin 54 and moved through the rod 56 by the follower 58A of a cam 58. The sector gear 50 rolls along a fixed sector rack 60, following a circular arc with the centre on the axis of the pin 54.

When the vials have been inverted, resiliently based expelling units 62 urge the vials, towards the top of the neck, so that each vial body is introduced into the containers or receptacles 3A of the conveyor 3, under the control of a slide 64 operated by a cam 66 and by a spring 68. The expelling units 62 are telescopic and held extended by springs so as to dampen the impact received by the vial when it encounters the container or receptacle bottom. The mechanism also has the task of facilitating the penetration into the receptacles 3A of the conveyor, should one vial be longer or shorter than the others.

Subsequently, the inverted vial neck is engraved and arranged for severing or breakdown at the station 9. A hardened steel disc 70 (FIGS. 11 and 12), rotated at high speed by a high frequency motor supplied from a converter, effects the engraving. The motor is fixed to an arm 72 pivoted on a rack pin 74 so that by means of a handwheel 76, the arm 72 bearing the motor of the disc 70 can be adjusted axially. The pin 74 is carried by a slide 78 which provides for horizontal sliding of the engraving disc 70 onto the vials to be cut during the same operation.

Figure 3:
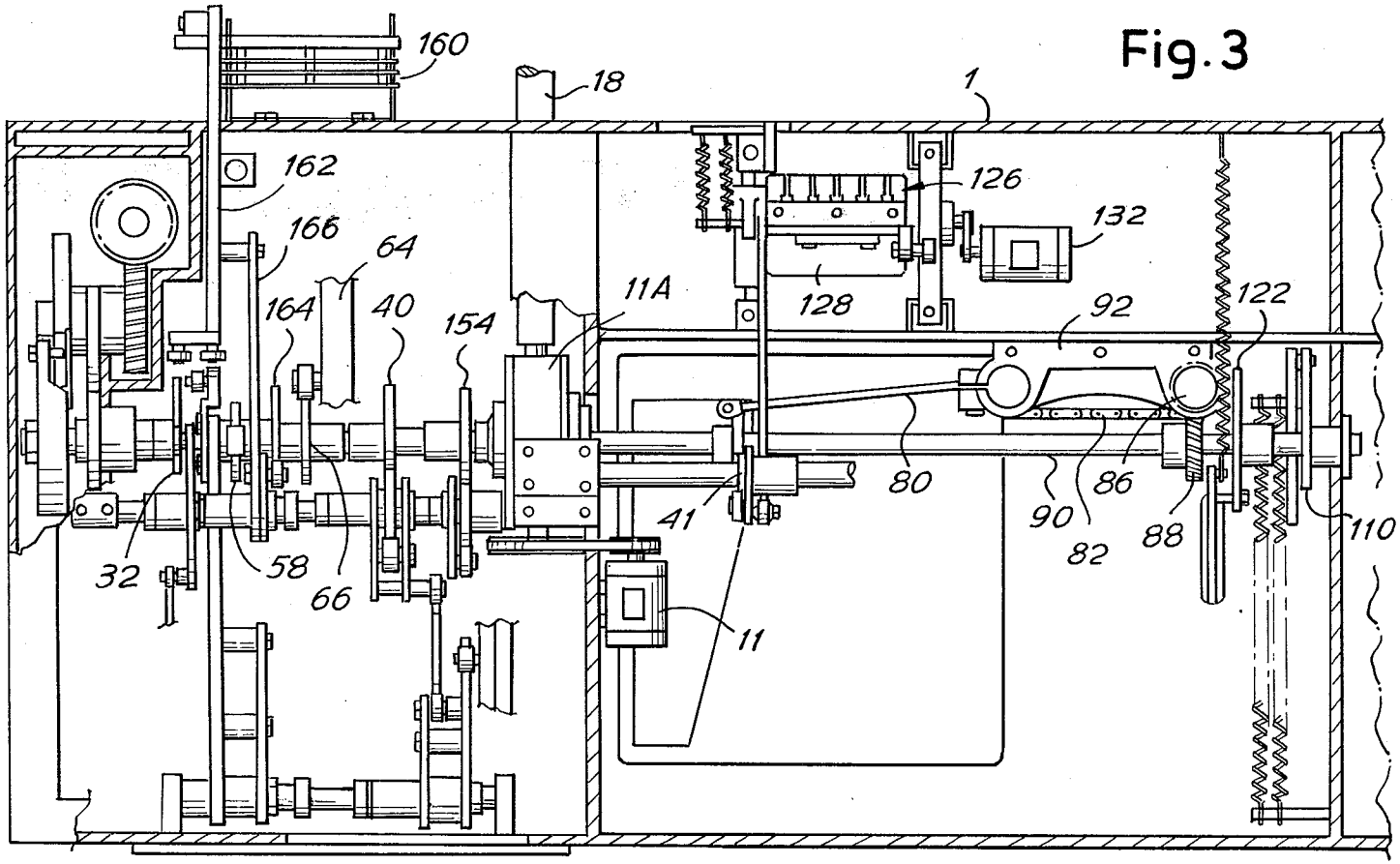
FIG. 3 is a longitudinal vertical section illustrating certain parts lying within the base of the machine.
Figure 11:
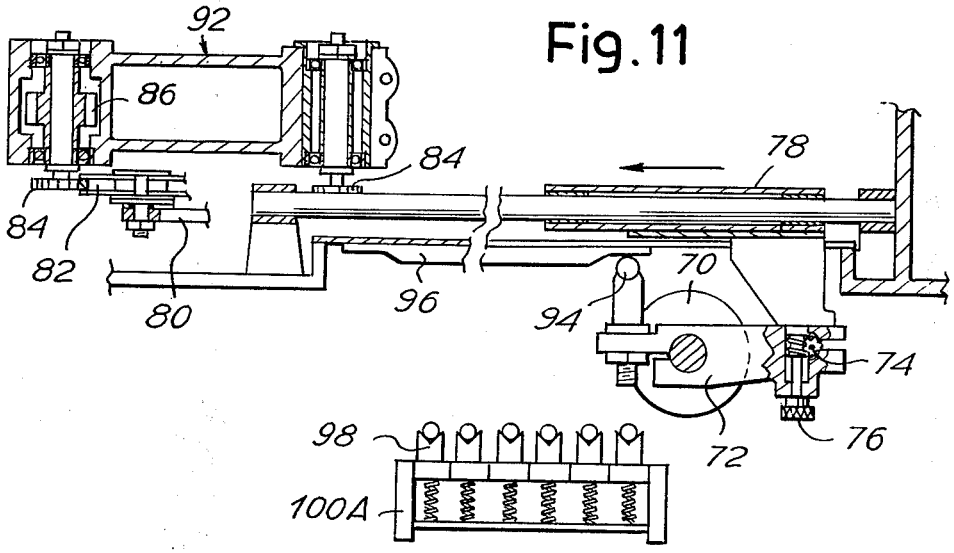
FIGS. 11 and 12 show details of an engraving device.
Figure 12:
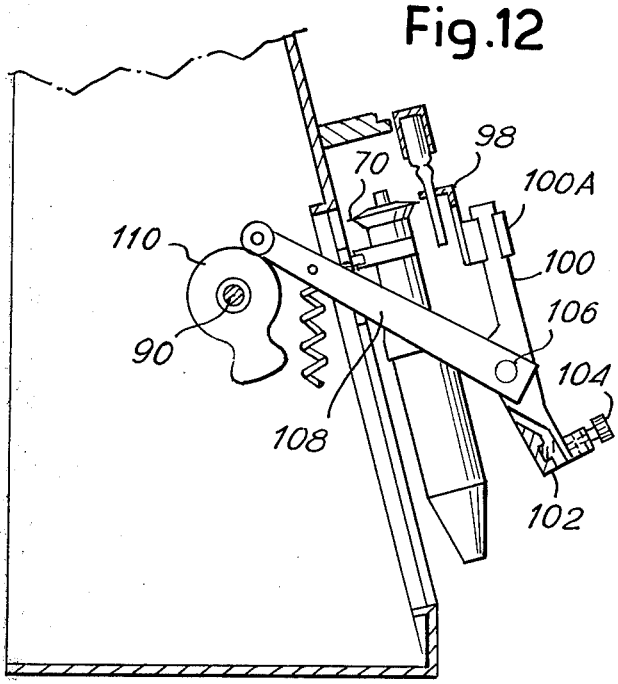
Figure 13:
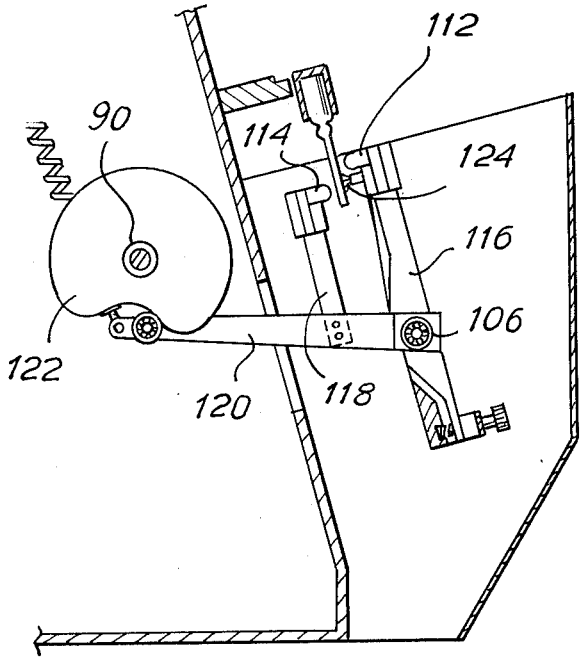
FIGS. 13 and 14 shown, respectively, a section and a side elevation of hammer units which serve to sever necks of the vials engraved by the device of FIGS. 11 and 12.

The slide is moved by a rod 80, secured to a chain 82 actuated by pinions 84, of which one is idle and the other fast with a gear wheel 86. The gear 86 is driven by another gear wheel 88 secured on the lower shaft 90 of the main drive of the machine, the chain 82 with its pinions being carried by a carrier 92 (FIGS. 3 and 11). A roller 94 mounted on the arm 72 is arranged to roll along a substantially horizontal elongate linear cam 96 and controls the movement of the engraving disc 70 towards the vials stationary on the conveyor 3, so that the engraving disc forms an engraved line on a portion thereof.

Figure 14:
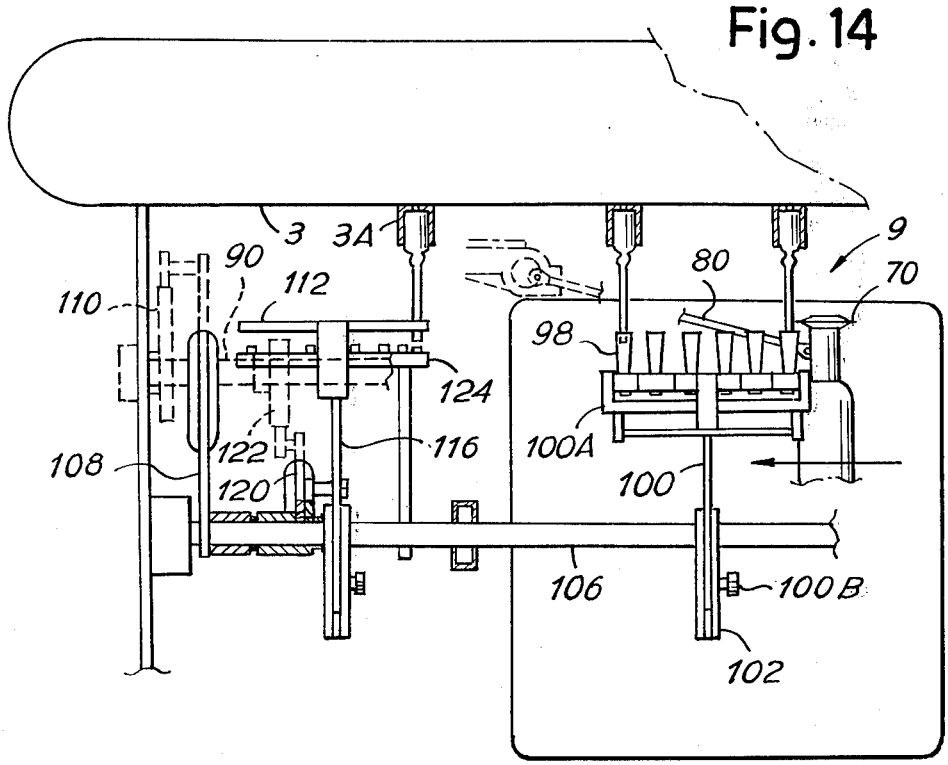

Appropriate centering units 98 (FIGS. 11 and 12) are resiliently carried on a frame 100A forming a part of a lever 100 clamped by means of a pressure screw 100B between the walls of a hollow lever 102 (FIG. 14). This arrangement enables, by means of the screw 104, manually to adjust the lever 100 carrying the centering units 98, relative to the vials. The hollow lever 102 is fixed to a shaft 106, which is driven by a lever 108 constituting the tappet of a cam 110 fixed on to the main lower shaft 90.

In the opening of the inverted vials, by cutting off their necks, when they are stationary and have been already engraved, hammers 112, 114 approach one another to effect the detachment of the necks. The hammer 112 is carried by an adjustable lever 116, similar to the lever 100, and is driven towards the vials by means of the shaft 106, in turn driven by the cam 110. The hammer 114 is carried by a lever 118, secured to a lever 120 which is idle on the shaft 106 and is controlled by a cam 122 of the shaft 90.

Before the detachment of the necks from the vials takes place, the necks are heated by the flames of gas burners 124 which are moved up to the vials together with the hammer 112, both being mounted on the shaft 106. The flames serve both to sterilize externally the fracture point and to increase the internal pressure of the vials by heating, so that, when the hammers effect the fractures a blast is produced, thus avoiding pieces of glass penetrating into the vial.

Figure 10:
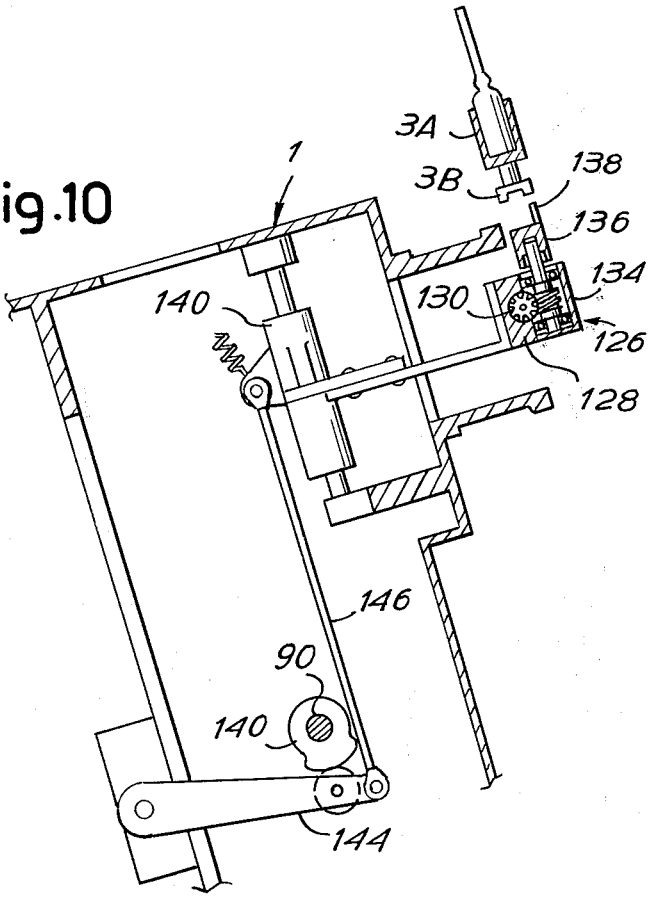
FIG. 10 is a section of a mechanism for effecting rotation of the vials during sealing.

After filling at the station 22, during closing of the vials by means of sealing with conventional gas burners, it is necessary that the vials be rotated so as to obtain a uniform sealing. For this purpose a mechanism 126 is provided which imparts rotation to the vials during the sealing stage. This mechanism includes a box 128 (FIGS. 3 and 10) carrying a shaft 130 having gear wheels mounted thereon driven continuously by a motor 132. The shaft 130 meshes, for each vial to be rotated with a gear 134, which is provided with a bush 136 bearing an eccentric pin 138 which can be introduced between two small wings 3B forming a part of the lower end of each container 3A of the chain or belt 3. The mechanism 126 is carried by a slide 140 and is moved towards the containers to be rotated, when the latter are stationary in the sealing position, by means of a cam 142 fast on the shaft 90 in the main drive of the lower portion of the machine. The cam 142 controls a lever 144 and a rod 146 and thus the slide 140 on which the mechanism is secured.

Figure 15:
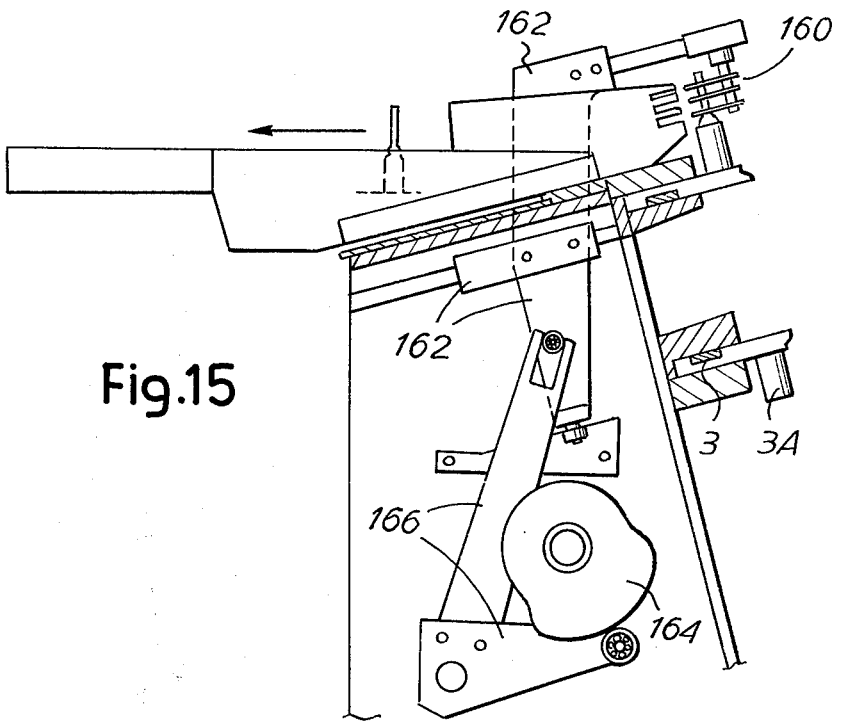
FIGS. 15 and 16 illustrate details of an unloading device forming a part of the machine.
Figure 16:
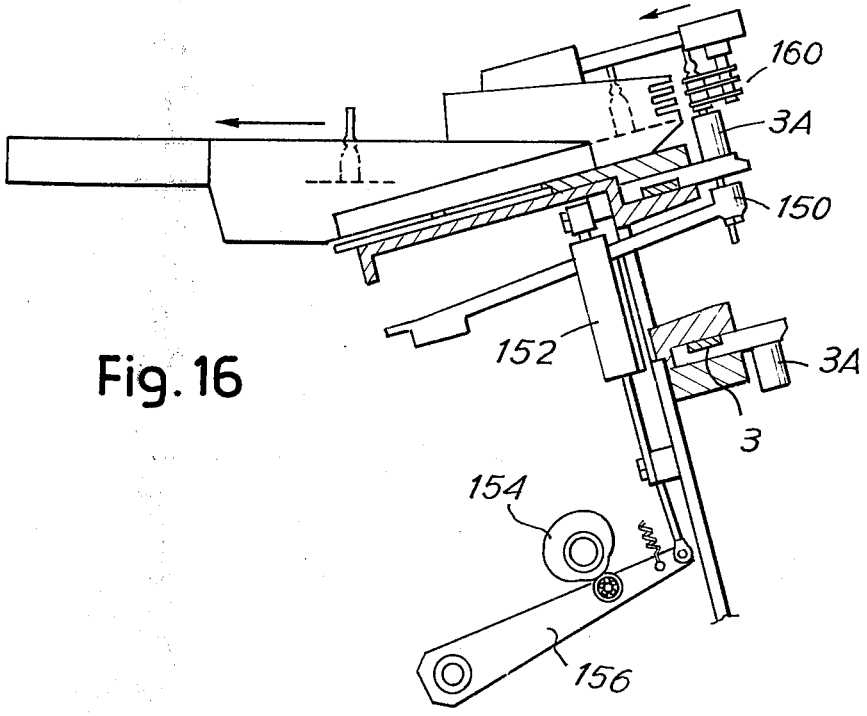

For unloading the vials from the chain or belt, an expelling device 150 (FIGS. 15 and 16) is employed and this is mounted on a slide 152 operated by a cam 154 through a lever 156. After the vials have been expelled from the containers or receptacles 3A, they are received by a comb or reed 160 fixed to a slide 162, operated by a cam 164 through a linkage 166. The comb provides for the alignment of the vials towards an unloading basket.

We claim:

1. A machine for filling in and sealing glass vials comprising, in combination, a frame; endless conveyor means mounted on said frame, and including an endless conveyor having an upper substantially horizontal run and a lower substantially horizontal run; receptacle secured to said conveyor and arranged to frictionally receive vertically oriented vials; driving means operable to drive said conveyor means; indexing means operable to index the conveyor means during each cycle of operation; means, at a station adjacent said lower substantially horizontal run, operable to supply a plurality of closed empty vials to said conveyor means by displacing the vials, in inverted relation, into said receptacles from beneath said lower substantially horizontal run; engraving means disposed at a station adjacent said lower substantially horizontal run of said conveyor means and operable to engrave a fracturing mark on the neck of each vial mounted in inverted relation in a receptacle; fracturing means adjacent said lower substantially horizontal run, downstream of said engraving means in the direction of movement of said endless conveyor, operable to fracture the necks of the vials at said fracturing marks; filling means at a station adjacent said upper substantially horizontal run and operable to fill the now upright vials having open necks; sealing means adjacent said upper substantially horizontal run and downstream of said filling means in the direction of movement of said endless conveyor, said sealing means including multiple burners positioned to heat the necks of the filled vials and pinch means operable to simultaneously close the necks of a plurality of filled valves; and means adjacent said upper substantially horizontal run operable, during the action of said burners and pinch means on the vials, to rotate the vials.

2. A machine according to claim 1 wherein the fracturing means lies adjacent the lower run of the conveyor means and comprises two hammers acting on the vial necks to sever them at the fracture zone engraved by the engraving means.

3. A machine according to claim 1, in which said supplying means comprises tilting gripper means positioned beneath said lower substantially horizontal run and adapted to receive several vials and resilient retain the vials; thrust means operable to thrust closed substantially upright empty vials upwardly into said tilting gripper means in one position of said gripper means; control means operatively associated with said gripper means and operable to tilt said gripper means to a second position in which the closed empty vials are inverted and aligned with receptacles on said lower substantially horizontal run; and expelling means operable, when said tilting means is in said second position to engage the inverted closed empty vials and push the same longitudinally out of said tilting gripper means into the conveyor receptacles.

4. A machine according to claim 3, in which said control means comprises a unit supporting said gripper means and mounted in said frame for oscillation about an axis; a sector gear fixedly mounted in said frame concentric with the axis of oscillation of said unit; and a gear wheel secured to said gripper means for rotation therewith and meshing with said sector gear whereby, upon oscillation of said unit, said gripper means is rotated between said first and second positions thereof.

5. A machine according to claim 1, wherein said engraving means comprises an engraving system sidably mounted on said frame for movement longitudinally of said conveyor beneath said lower substantially horizontal run thereof; said engraving system including a high frequency motor movable therewith and having a motor shaft rotating at a high speed, and a steel disk secured on said motor shaft; said steel disk, during sliding of said engraving system longitudinally relative to said conveyor, moving along the necks of a row of inverted closed empty vials in said receptacles to engrave said necks; said engraving means further including a centering device engageable with the group of vials positioned for engagement by said engraving means and holding the vials of said group in alignment, said centering device extending parallel to the direction of sliding movement of said engraving system.

6. A machine according to claim 1, including a burner system mounted in said frame adjacent said fracturing means and operable, before and during fracturing of the necks of inverted closed empty dials, to sterilize the fracture zones and to increase the internal pressure of the dials so that, upon fracturing of the necks of the vials by said fracturing means, a blast of air under pressure is discharged from the fractured necks of the vials to prevent ingress of glass fragments into the inverted vial.

7. A machine according to claim 1, in which said receptacles are mounted on said conveyor for rotation about axes extending substantially perpendicular to said conveyor; and means located adjacent said upper substantially horizontal run of said conveyor adjacent said sealing means and operable to engage and rotate said receptacles to rotate the vials during the action of said burners and pinch means on the vials.

8. A machine according to claim 7, in which each receptacle is formed with an aperture in its base to provide for entry of expelling means into the receptacle to expel a vial therefrom; and expelling means mounted on said frame adjacent said upper substantially horizontal run of said conveyor and downstream of said sealing means in the direction of movement of said upper substantially horizontal run, said expelling means including expelling elements and means for moving said expelling elements into and through the base apertures of said receptacles to expel vials therefrom.

* * * * *